US006722774B2

(12) United States Patent
Kovacik et al.

(10) Patent No.: US 6,722,774 B2
(45) Date of Patent: Apr. 20, 2004

(54) DOUBLE LAMP UTILITY LIGHT

(75) Inventors: James D. Kovacik, Brecksville, OH (US); Paul S. Blanch, Broadview Heights, OH (US); Joseph J. Smith, Wooster, OH (US)

(73) Assignee: Alert Safety Lite Products Co, INC, Bedford Hts., OH (US)

( * ) Notice: Subject to any disclaimer, the term of this patent is extended or adjusted under 35 U.S.C. 154(b) by 0 days.

(21) Appl. No.: 10/447,867

(22) Filed: May 29, 2003

(65) Prior Publication Data

US 2003/0206413 A1 Nov. 6, 2003

Related U.S. Application Data

(63) Continuation of application No. 09/928,805, filed on Aug. 14, 2001.

(51) Int. Cl.[7] ..... F21V 21/00; F21V 19/02

(52) U.S. Cl. ..... 362/396; 362/418; 362/427; 362/251; 362/249; 362/225

(58) Field of Search ..... 362/396, 418, 362/427, 287, 223, 249, 235, 225, 260, 251

(56) References Cited

U.S. PATENT DOCUMENTS

| | | | | | |
|---|---|---|---|---|---|
| 2,085,683 | A | * | 6/1937 | McGill | 362/396 |
| 2,369,123 | A | * | 2/1945 | Abshire | 362/396 |
| 2,899,542 | A | | 8/1959 | Mauro | |
| 3,380,770 | A | | 4/1968 | Risley | |
| 3,671,739 | A | | 6/1972 | McCain | |
| 4,019,047 | A | | 4/1977 | Frey | |
| 4,262,327 | A | | 4/1981 | Kovacik et al. | |
| 4,287,456 | A | | 9/1981 | Kovacik et al. | |
| 4,432,043 | A | | 2/1984 | Yuen | |
| 4,460,947 | A | | 7/1984 | Kelly | |
| 4,862,334 | A | | 8/1989 | Ivey et al. | |
| 4,958,267 | A | | 9/1990 | Baake | |
| 5,163,751 | A | * | 11/1992 | Bottiglieri | 362/376 |
| 5,177,404 | A | | 1/1993 | Cohen et al. | |
| 5,243,505 | A | | 9/1993 | Carr | |
| 5,301,093 | A | | 4/1994 | Baggio | |
| 5,349,511 | A | * | 9/1994 | Henderson | 362/396 |
| 5,436,815 | A | | 7/1995 | Grooms et al. | |
| 5,465,196 | A | | 11/1995 | Hasenberg et al. | |
| D367,123 | S | | 2/1996 | Blye | |
| D367,542 | S | | 2/1996 | Kovacik et al. | |
| 5,493,482 | A | | 2/1996 | Bowen | |
| 5,528,477 | A | | 6/1996 | Carmo | |
| D389,931 | S | | 1/1998 | Kovacik et al. | |
| 5,765,941 | A | | 6/1998 | Vest | |
| D409,776 | S | | 5/1999 | Ghode et al. | |
| 5,921,658 | A | | 7/1999 | Kovacik et al. | |
| D421,143 | S | | 2/2000 | Kovacik et al. | |
| 6,123,434 | A | | 9/2000 | Meltzer | |
| 6,176,592 | B1 | | 1/2001 | Kovacik et al. | |
| D458,400 | S | | 6/2002 | Kovacik et al. | |
| 6,534,926 | B1 | | 3/2003 | Miller et al. | |
| 6,585,400 | B2 | * | 7/2003 | Leen | 362/418 |
| 6,601,814 | B2 | * | 8/2003 | Kovacik et al. | 248/339 |

* cited by examiner

*Primary Examiner*—Thomas M. Sember
(74) *Attorney, Agent, or Firm*—MacMillan, Sobanski & Todd, LLC

(57) ABSTRACT

A double lamp utility light includes a vertically split light housing formed in two halves with an elongated upper light portion extending from a hollow lower handle portion. An electrical outlet is provided in a bottom surface of the handle. A pair of switches on the handle control respective ones of a pair of twin bulb fluorescent lamp assemblies. A lens assembly is releasably attached to the housing and can be removed and installed without tools for changing the lamp assemblies.

9 Claims, 4 Drawing Sheets

DOUBLE LAMP UTILITY LIGHT

CROSS-REFERENCE TO RELATED APPLICATION

This application is a continuation of the co-pending U.S. patent application Ser. No. 09/928,805 filed Aug. 14, 2001.

BACKGROUND OF THE INVENTION

The present invention relates generally to illumination devices and, in particular, to a novel double lamp utility light.

Portable lights, which can be manually moved and suspended about a work site to aid a user to obtain the best lighting conditions, are well known. It has been the practice to use incandescent light bulbs, suitably encased in light guards, for this purpose. Such lights are often referred to as trouble lamps, extension lights, work lights, inspection lights, utility lights, and the like, and are commonly employed by mechanics and other workers who require a concentration of light while frequently changing locations. Such a trouble light is shown in the U.S. Pat. No. 4,774,647 to Kovacik et al.

Fluorescent lights have several advantages in use as compared with the incandescent bulbs. As an example, for the same wattage fluorescent lights usually provide more light with less glare. In the past, attempts have been made to convert portable lights such as extension lights to fluorescent tubes. However, a number of problems have arisen, particularly in attempting to adapt a fluorescent tube to a satisfactory portable assembly, including electrical contact problems with the tubes, and problems arising when the tubes need replacement.

The U.S. Pat. No. 4,262,327 shows a portable fluorescent tube having a lens and a hook for hanging the assembly. The assembly includes a tubular envelope surrounding a standard fluorescent tube and closed by a pair of end sockets. One of the end sockets has a starter switch mounted thereon and a ballast is connected in an electrical supply line near an electrical plug. However, in order to change the fluorescent tube, such a light assembly must be disassembled.

Many prior art portable fluorescent tube assemblies require the use of tools to disassemble the light assembly in order to replace the fluorescent tubes. Portable light assemblies are also notoriously and disadvantageously susceptible to tube breakage, primarily because portable light assemblies are much more likely to be handled roughly, dropped or, at a minimum, subject to jarring, vibration, and the like. In addition, utility lights typically provide a fixed amount of illumination once energized. Those skilled in the art will appreciate that the same amount of illumination is not in required for every work location. Those skilled in the art will also realize that because of the frequently changing location of the utility light, finding a location for hanging and correctly orienting the light is often difficult.

The art continues to seek improvements. It is desirable to provide a portable light assembly that does not require the use of tools to change the fluorescent bulbs. It is also desirable to provide a utility light that is able to vary the amount of illumination it provides and is resistant to tube breakage.

It is desirable to provide a portable light with multiple suspension options in order to be able to place and orient the portable light in as many locations and positions as possible. It is always desirable to provide utility lamps that are lightweight and cost-effective to produce.

It is an object of the invention, therefore, to provide a utility light with a means to vary the amount of illumination that also may be disassembled and assembled by hand to replace the fluorescent tubes. It is another object of the invention to provide a lightweight, cost-effective utility lamp with multiple suspension options that is resistant to tube breakage.

SUMMARY OF THE INVENTION

The present invention concerns a double lamp utility light. The utility light includes a vertically split light housing with an upper light portion extending from a generally hollow lower handle portion, the light portion having a lens opening formed thereon. Upper and lower hooks for hanging the utility light are attached to the light housing.

A power cord with a strain relief means is received in a bottom surface of the handle portion. The power cord is used to provide power to the utility light from an electrical cord extending from a common electrical outlet. An integral outlet is also received in a bottom surface of the handle portion, and is electrically connected to the power cord. The cord set also provides power to a circuit board means.

The circuit board means is received in the hollow handle portion of the light housing. The circuit board means includes a ballast and is used to provide power to the remainder of the electrical circuit.

A double switch is mounted on the handle portion and is electrically connected to the circuit board means. The switch supplies power from the circuit board means to a double fluorescent lamp socket. The lamp socket is electrically connected to the double switch to independently switch two double lamp assemblies. Each lamp assembly includes a base member that receives two tubular fluorescent bulbs.

The lens opening of the light portion of the light housing receives the lamp assemblies and a reflector. A lens assembly is releasably attached to the light housing and encloses the lens opening. A lamp cushion receives the fluorescent bulbs and contacts an interior surface of the attached light portion and lens assembly. A housing cushion receives a top portion of the assembled light portion and lens assembly. A handle cushion is received in a channel formed in the handle portion of the housing.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
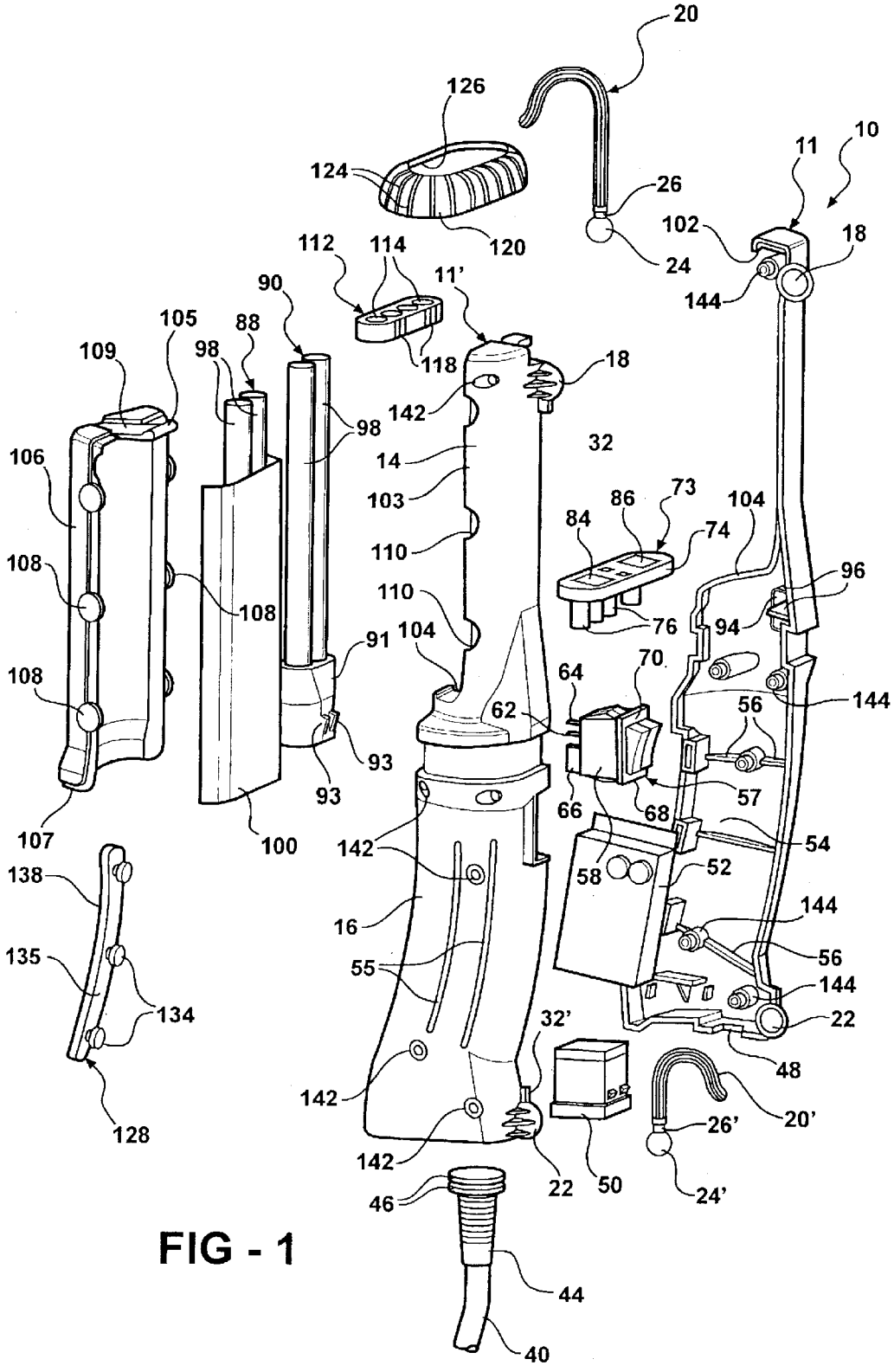
FIG. 1 is an exploded perspective view of a utility light in accordance with the present invention.
Figure 2:
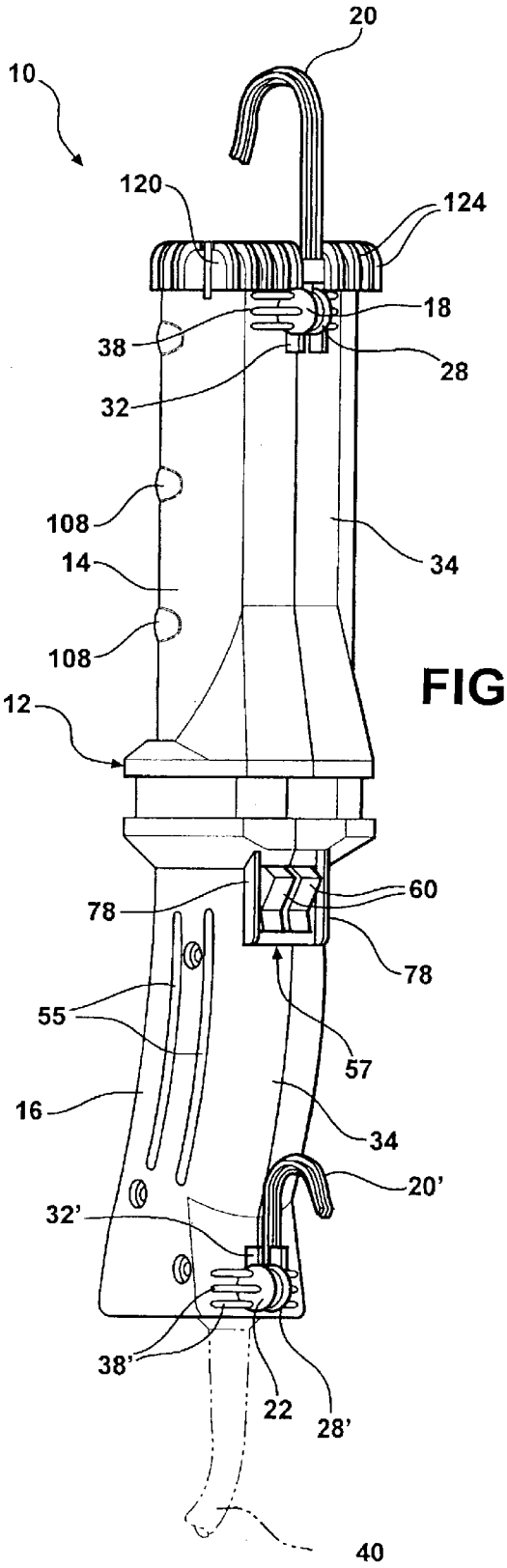
FIG. 2 is a perspective view of the utility light shown in FIG. 1 as assembled.
Figure 3:
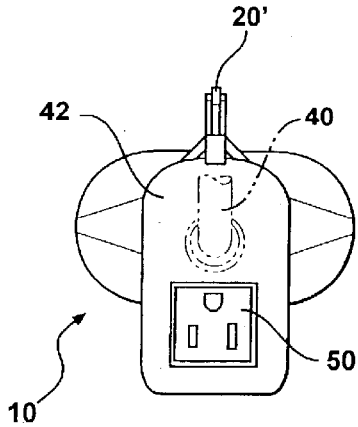
FIG. 3 is a bottom plan view of the utility light shown in FIG. 2.
Figure 4:
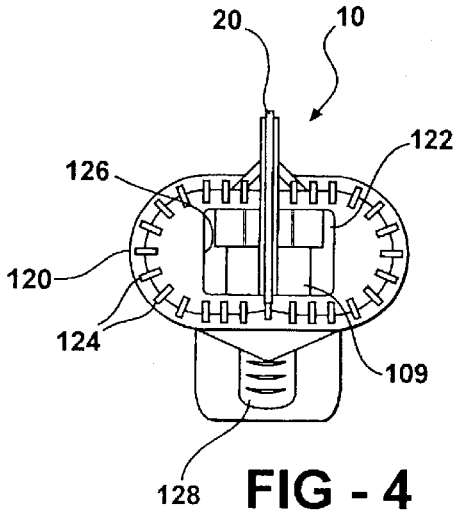
FIG. 4 is a top plan view of a utility light shown in FIG. 2.
Figure 5:
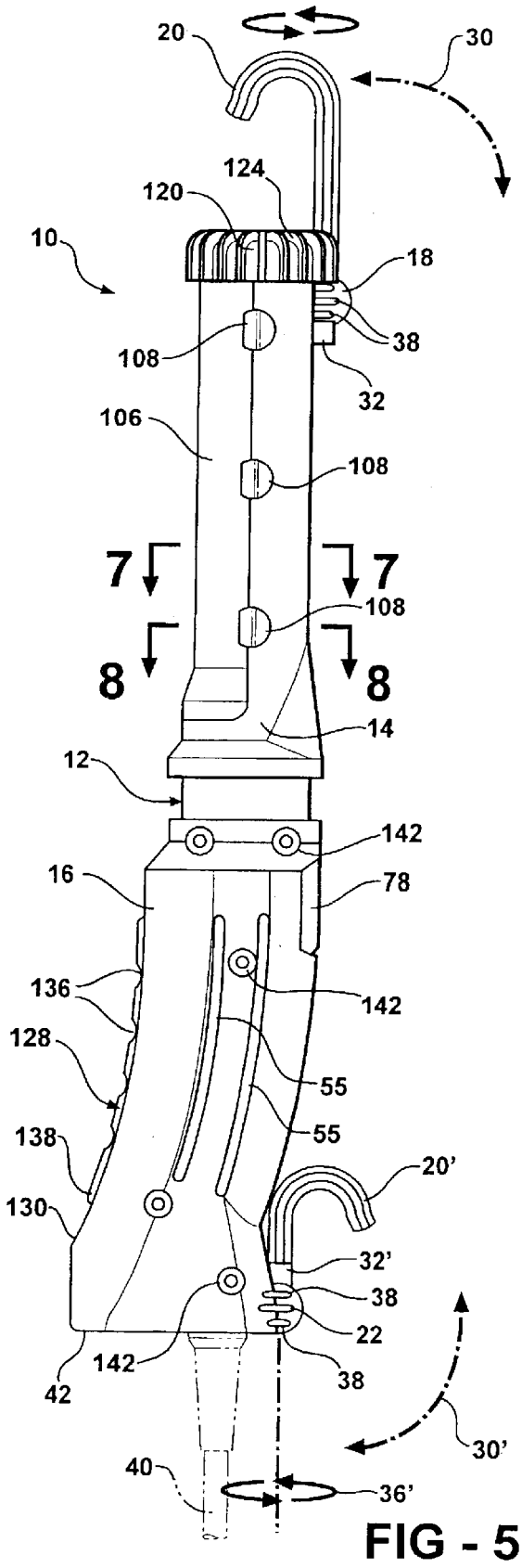
FIG. 5 is a right side elevation view of the utility light shown in FIG. 2.
Figure 6:
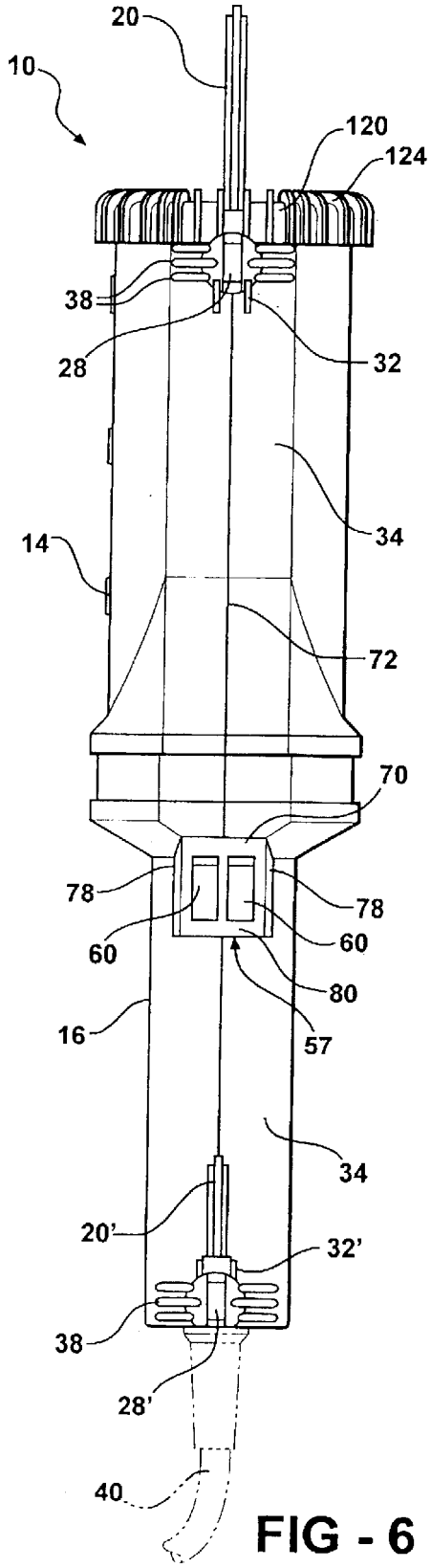
FIG. 6 is a rear elevation view of the utility light shown in FIG. 2.

Referring now to all of the drawing figures, a double lamp utility light is indicated generally at 10. The utility light 10 includes a vertically split hollow light housing 12 formed in two housing halves 11 and 11' with an elongated upper light portion 14 extending from a hollow lower handle portion 16. The handle portion 16 is preferably ergonomically curved to allow the utility light 10 to be easily manipulated during use. The housing 12 is preferably formed of a lightweight material, such as plastic, as the utility light 10 is contemplated to be both handheld and portable.

Each half 11 and 11' of the split housing 12 includes an outwardly extending half upper socket 18 for receiving an upper hook 20 and an outwardly extending half lower socket 22 for receiving a lower hook 20'. The upper 20 and lower 20' hooks are substantially identical and include ball portions 24 and 24' respectively that are connected to shanks 26 and 26' respectively, which are further connected to the hook members 20 and 20' respectively. The ball portions 24 and 24' are retained between the halves of the respective sockets 18 and 20, forming a pair of ball and socket connections. When the halves 11 and 11' of the split housing 12 are joined, recesses formed in facing surfaces of the halves of the sockets 18 and 20 receive the ball portions 24 and 24' respectively. The facing surfaces are spaced apart to define channels 28 and 28' that function as a guide for the shank portions 26 and 26' respectively to allow the hooks 20 and 20' to pivot only in a generally vertical plane as shown by arrows 30 and 30'. Two pairs of walls 32 and 32' extend outwardly from a rear surface 34 of the housing 12 with each wall 32 and 32' adjacent one of the sockets 18 and 22 to function as storage supports on either side of the shanks 26 and 26' of the hooks 20 and 20'. The hooks 20 and 20', once moved beyond the projections 32 and 32', are free to rotate about a longitudinal axis of the utility light as shown by arrows 36 and 36'. A plurality of transverse strengthening ribs 38 extend between the sockets 18 and 22 and the housing 12. Preferably, the upper hook 20 is of a larger size than the lower hook 20'.

A power cord 40 extends through an aperture (not shown) in a bottom surface 42 of the handle portion 16 and is used to provide power to the circuitry, discussed below, that is enclosed within the handle portion 16. A split member strain relief means 44 is attached to the power cord 40. The diameter of the strain relief means 44 gradually tapers radially outwardly to a pair spaced radial projections 46 that cooperate with a wall 48 of the bottom surface 42 to retain the power cord 40 in place should the power cord 40 be pulled outwardly from the bottom surface 42, in order that the projections 46 absorb any forces so that the electrical connections with the circuitry may be maintained. The end of the power cord 40 has a male plug (not shown) for insertion into a common female electrical power receptacle. An integral electrical outlet 50 is provided in another aperture in the bottom surface 42. The outlet 50 is preferably a standard female three-prong grounded electrical outlet and is electrically connected (not shown) to the power cord 40 so that the outlet 50 is energized when the power cord 40 is energized. The outlet 50 can be utilized, for example, to receive an electrical plug at the end of a power cord for an electrically powered tool (not shown) or another light fixture (not shown).

A circuit board assembly 52 is received in an interior recess 54 in the hollow handle portion 16. The recess 54 is bounded by a plurality of ribs 56 that aid in both aligning the circuit board assembly 52 in the handle portion 16 and in preventing movement of the circuit board assembly 52 once mounted in the recess 54 and the housing halves 11 and 11' are joined. The circuit board assembly 52 includes a ballast for the utility light 10. A plurality of slots 55 are formed in a side wall of each half of the handle portion 16 to provide air circulation and release heat generated by the circuit board assembly 52. The circuit board assembly 52 is electrically connected to the power cord 40, and is preferably a commercially available circuit board. The circuit board assembly 52 provides power to the remainder of the electrical circuitry enclosed within the handle portion 16.

A double switch 57 includes a switch housing 58 with two switch rockers 60 each associated with a separate first electrical terminal 62 and a separate second electrical terminal 64 extending downwardly from a bottom surface of the housing 58. A downwardly projecting planar divider 66 separates the terminals 62 and 64 of each switch rockers 60. The switch housing 58 includes a lip 68 that extends around an upper surface 70 of the double switch 57 so that the double switch 57 may be mounted coplanar with the rear surface 34 of the housing 12. The first electrical terminal 62 of each switch is electrically connected to the circuit board assembly 52, while the second electrical terminal 64 of each switch is electrically connected to an electrical terminal 76 of a lamp socket 73. The double switch 57 is easily actuated by a thumb or finger of a person (not shown) holding the handle portion 16 to light one or both of the lamp assemblies 88 and 90 with one hand while also orienting and hanging the light 10 with the same hand. A pair of outwardly extending walls 78 form a channel 80 on the rear surface 34 of the housing 12 in which channel the switch 57 is located to help prevent accidental actuation of either of the switch rockers 60.

The lamp socket 73 includes a generally disk-shaped socket housing 74 having two sockets 84 and 86 formed therein each for receiving a fluorescent lamp assembly 88 or 90. The plurality of electrical terminals 76 that extend downwardly from a bottom surface of the socket housing 74 from each of the sockets 84 and 86 are electrically connected to the respective second electrical terminals 64 of the switch member 60, each of the sockets 84 and 86 and switch members 60 forming a separate electrical circuit. The socket housing 74 is slidingly received in a cavity 94 at an upper end of the handle portion 16 formed by two longitudinally spaced parallel ribs 96. The ribs 96 aid in aligning the socket housing 74 and in preventing movement of the socket 73 during use of the utility light 10. The lamp socket 73 is preferably a commercially available socket.

The sockets 84 and 86 each receive one of a corresponding two sets of fluorescent lamp assemblies 88 and 90. Each lamp assembly 88 and 90 is substantially identical and may be received by either socket 84 and 86. Each lamp assembly 88 and 90 includes two fluorescent bulbs 98 and that are received by a base 91 having a plurality of electrical contacts 93 that cooperate with interior electrical contacts (not shown) in the sockets 84 and 86. The base 91 includes internal electrical contacts (not shown) for the bulbs 98. If a bulb 98 fails, the lamp assemblies 88 and 90 are replaced as an assembly; the individual bulbs 98 are not replaced. When either of the switch members 60 are activated, power is sent to the associated socket 84 or 86 and thus to the associated lamp assembly 88 or 90, each of the lamp assemblies, the sockets and the switch forming a separate electrical circuit. A reflector 100 for directing the illumination towards a work area (not shown) and away from the light portion 14 is attached on a posterior side of the lamp assemblies 88 and 90, and cooperates with notches (not shown) on an interior surface of the light portion 14.

The upper light portion 14 of the light housing 12 is generally arcuate in cross-section and the halves of the upper light portion 14 are joined at a seam 72 on the rear surface 34 of the housing 12. Each half of the light portion 14 is open at a front side and top of the light for receiving the lamp assemblies 88 and 90 and reflector 100 during assembly. A downwardly opening groove 102 is formed in a top area of the light portion 14 at an upper periphery of the opening. Each side area of the light portion 14 terminates in a flange 103 at a side periphery of the opening. An upwardly opening groove 104 is formed in lower area of the light portion 14 at a bottom periphery of the opening. A lens assembly 106 is generally arcuate in cross-section with a tongue 107 extending downwardly from a lower edge and a plurality of tabs 108 extending from side edges. A generally horizontally extending arm 109 is formed at an upper wall area of the lens assembly 106. The arm 109 has an upwardly extending tongue 105 formed at a free end thereof. A plurality of cutouts 110 are formed in the flange 103 and are spaced to correspond to the tabs 108.

Figure 7:
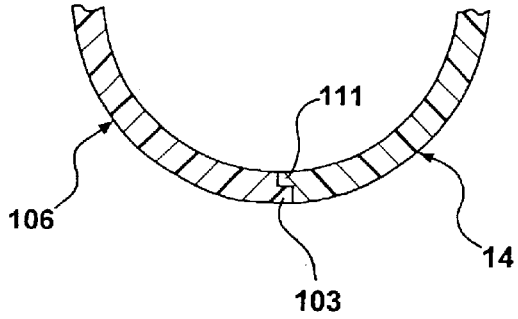
FIG. 7 is an enlarged fragmentary cross-sectional view as if taken along the line 7—7 in FIG. 5.
Figure 8:
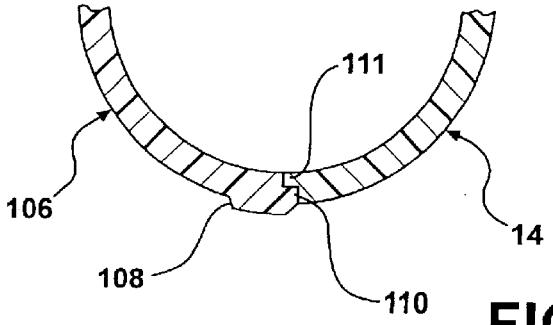
FIG. 8 is an enlarged fragmentary cross-sectional view as if taken along the line 8—8 in FIG. 5.

To attach the lens assembly 106 to the light portion 14, the lower end of the lens assembly is placed in the light portion opening with the lower tongue 107 inserted into the lower groove 104. The arm 109 is depressed while moving the upper end of the lens assembly 106 into the opening and then the arm 109 is released to permit the upper tongue to engage the upper groove 102. Now the lens assembly 106 is releasably attached to the light housing 12. As best shown in FIG. 7, the flanges 103 cooperate with flanges 111 formed at side edges of the lens assembly 106 to seal the mating edges. As best shown in the FIG. 8, the tabs 108 extend beyond the flanges 111 into the corresponding cutouts 110 to cooperate with the wall of the light portion 14. Thus, the flange 103 prevents the lens assembly 106 from flexing radially outwardly while the tabs 108 prevent flexation of the lens assembly 106 radially inwardly.

A generally disk-shaped lamp cushion 112 includes four apertures 114 for receiving a top portion of the bulbs 98 of the lamp assemblies 88 and 90. The lamp cushion 112 is preferably press-fit over the bulbs 98 and rests under the finger 107. The lamp cushion 112 has a plurality of vertically extending fins 118 formed thereon. The inwardly projecting finger 107 from the lens assembly 106 aids in retaining the lamp cushion 112 in place after the lens assembly 106 and the light portion 12 have been assembled. The lamp cushion 112 is preferably constructed of a deformable, resilient shock absorbing material.

A generally disk-shaped housing cushion 120 is received by a top portion 122 of the assembled lens assembly 106 and light portion 16. The housing cushion 120 includes a plurality of external fins 124 and absorbs shock forces encountered during use of the utility lamp 10. The housing cushion 120 is preferably press fit over the top portion 122. The housing cushion 120 is preferably constructed of a deformable, resilient shock absorbing material. A central aperture or opening 126 is formed in the cushion 120 for access to the arm 109.

An elongated handle cushion 128 is received in a channel (not shown) on a front surface 130 of the light housing 12. The channel is preferably formed on a seam (not shown) formed between the halves of the handle portion 16. The handle cushion 128 includes projections 134 on a back surface 135 that are press fit into recesses (not shown) in the channel for retaining the handle cushion 128 to the handle portion 16. The handle cushion 128 includes ergonomically shaped ridges 136 on a front surface 138 to engage, with minimum discomfort, the fingers of a person (not shown) using the lamp. The handle cushion 128 is preferably constructed of a soft, easily deflectable material.

The split halves 11 and 11' of the light housing 12 are joined by a plurality of fasteners such as screws (not shown) to complete the assembly of the halves of the housing 12. The screws are received in apertures 142 formed in the half 11' of the housing 12, and fastened to corresponding tapped cylindrical posts 144 formed in an interior wall in the half 11 of the housing 12.

After the utility light 10 has been assembled with the screws, it is ready for use. To replace a lamp assembly 88 or 90, one must simply remove the housing cushion 120, detach the lens assembly 106, remove the lamp cushion 112, and remove the lamp assembly 88 or 90 from the socket 73. After a new lamp assembly 88 or 90 has been inserted in the socket 73, the above steps are reversed. All of the above steps may be advantageously performed by hand, without the use of tools. Downward force applied to the arm 109 releases the upper tongue 105 from the groove 104. Contacting an opposed pair of the tabs 108 with a thumb and finger enables one to pull the lens assembly 106 away from the opening in the light portion 14.

Figure 9:
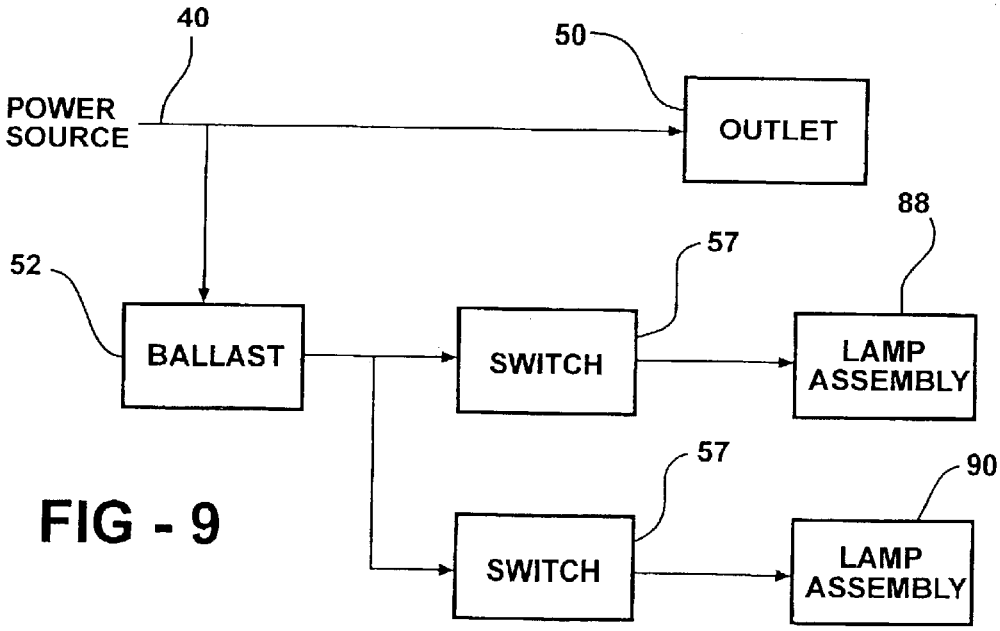
FIG. 9 is an electrical schematic diagram of the utility light shown in FIG. 2.

An electrical schematic of the utility light 10 is shown in FIG. 9. The cord 40 is provided for connection to an external power source which connection will render the outlet 50 "live. The electrical power from the cord 40 is directed through the ballast 52 to one of the switches 57 which switches individually control the lamp assemblies 88 and 90.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A utility light comprising:

a hollow light housing having an exterior front surface and an exterior rear surface, said housing further having an upper light portion with a lens opening formed in said front surface and a lower handle portion;

a pair of lamp assemblies mounted side-by-side in said light portion and being connected to switch means for individually turning "on" and "off" each of said lamp assemblies;

a reflector mounted in said light portion on an opposite side of said lamp assemblies from said lens opening;

a pair of hooks each attached to said housing by an associated ball and socket connection, one of said hooks being positioned adjacent an upper end of said light portion and another of said hooks being positioned adjacent a lower end of said handle portion; and a lens assembly removably mounted in said lens opening.

2. The utility light according to claim 1 wherein said handle portion is curved from an upper end of said handle portion to said lower end of said handle portion.

3. The utility light according to claim 1 wherein each said lamp assembly has two fluorescent bulbs.

4. The utility light according to claim 1 including a lamp cushion engaging an upper end of each of said lamp assemblies.

5. The utility light according to claim 1 including an electrical outlet mounted in said lower end of said handle portion.

6. The utility light according to claim 1 wherein said lens assembly has a front wall attached to an upper wall and a pair of side walls.

7. The utility light according to claim 6 wherein said lens assembly side walls each have a flange formed at an edge thereof and said light housing has flanges formed at an edge of said lens opening, said light housing flanges cooperating with said side wall flanges when said lens assembly is mounted in said lens opening.

8. A utility light comprising:

a hollow light housing having an exterior front surface, an exterior rear surface, an upper light portion with a lens opening formed in said front surface and a lower handle portion, said light housing being longitudinally splint into a pair of mirror image housing halves;

a pair of lamp assemblies mounted side-by-side in said light portion and being connected to switch means for individually turning "on" and "off" each of said lamp assemblies;

a reflector mounted in said light portion on an opposite side of said lamp assemblies from said lens opening;

at least one hook attached to said housing by an associated ball and socket connection and being positioned adjacent a lower end of said handle portion; and a lens assembly removably mounted in said lens opening.

9. The utility light according to claim 8 including another hook attached to said housing by an associated ball and socket connection and being positioned adjacent an upper end of said light portion.

* * * * *